US009078469B2

(12) United States Patent
Starič et al.

(10) Patent No.: US 9,078,469 B2
(45) Date of Patent: Jul. 14, 2015

(54) PACKAGE AND DEVICE FOR MANUAL ROLLING OF CIGARETTES

(75) Inventors: Jure Starič, Grosuplje (SI); Anže Pivk, Ljubijana (SI); Nahtigal Žiga, Ljubljana (SI)

(73) Assignee: Ziggi Proizvodnja In Trgovina, D.O.O., Ljubljana (SI)

( * ) Notice: Subject to any disclaimer, the term of this patent is extended or adjusted under 35 U.S.C. 154(b) by 886 days.

(21) Appl. No.: 13/316,024

(22) Filed: Dec. 9, 2011

(65) Prior Publication Data

US 2012/0167900 A1 Jul. 5, 2012

Related U.S. Application Data

(63) Continuation of application No. PCT/SI2010/000034, filed on Jun. 7, 2010.

(51) Int. Cl.
*A24F 17/00* (2006.01)
*A24C 5/44* (2006.01)

(52) U.S. Cl.
CPC .. *A24C 5/44* (2013.01); *A24F 17/00* (2013.01)

(58) Field of Classification Search
None
See application file for complete search history.

(56) References Cited

U.S. PATENT DOCUMENTS 8,584,854 B2 * 11/2013 Kesselman et al. ..... 206/494

* cited by examiner

*Primary Examiner* — Michael J Felton
(74) *Attorney, Agent, or Firm* — The Watson IP Group, PLC; Jovan N. Jovanovic; Vladan M. Vasiljevic

(57) ABSTRACT

A packaging for manual rolling of cigarettes comprising smoker's accessories like cigarette sheets, filters, sheets, matches, lighters, tobacco and an article usable as an advertising material is characterized in that the base line is foldably divided into two small sides with a narrow band therebetween. The intermediate band is terminated at both sides each time with two triangular parts, providing for creating a handy table for rolling cigarettes. The narrow band is foldably divided in a way that the external parts are embraced by triangular folded corners of smaller sides. While the device is in use, the packaging is opened and put onto a support in a way that small sides are lifted upwards. The triangular sides on both sides of the narrow band are then pushed upwards to create bulges. The two bulges each from its side stop the narrow side and prevent the content from falling from the support.

13 Claims, 12 Drawing Sheets

PACKAGE AND DEVICE FOR MANUAL ROLLING OF CIGARETTES

CROSS REFERENCE TO RELATED APPLICATION

This is a continuation of PCT application No. PCT/SI2010/000034 filed Jun. 7, 2010, entitled "Package and device for manual rolling of cigarettes" which claims priority from Slovenian Patent Application No. P-200900160 filed Jun. 9, 2009, and each of the foregoing are incorporated herein in their entirety by reference.

BACKGROUND OF THE INVENTION

1. Field of the Invention

The invention belongs to the field of accessories for smokers, more precisely to the field of packaging for smoker's articles like cigarette sheets, cigarette filters, filter tips, matches, lighters, tobacco and the like as well as any other article that may as well be used as an advertising material.

2. Technical Problem

A technical problem solved by the present invention is a constructional solution to a packaging for smoker's articles having a possibility of being converted into a handy support for preparation and manual rolling of cigarettes. Apart from allowing for a simple opening and closing of the container for smoker's articles, the solution must also allow conversion into a manual or stand-alone support/table for rolling one's own cigarette.

A problem encountered by a smoker when wanting to roll a cigarette lies in that he must, prior to preparation, look for an area, where he would place a cigarette paper, put tobacco thereon, equally distribute it, add a filter and finally roll his cigarette. A smoker is encountered by the following problems:

- he must look for an ergonomically adequate place that is not always available, onto which he can put a cigarette paper,
- a question of hygiene appears, as the environment is most often not adequate to be contacted with products that end in the mouth of smokers and come in contact with a mucous membrane,
- after a cigarette has been rolled, superfluous tobacco ends on the table or floor.

PRIOR ART

Various accessories and devices for rolling cigarettes are known, yet a majority of them is intended for industrial production of cigarettes, mechanical rolling of cigarettes or are meant merely for storing industrially rolled cigarettes or other smoker's articles.

The patent application US2004144660 discloses a packaging for storing smoking accessories that does not function as an accessory or support, on which a cigarette could be rolled.

The patent applications WO2009020383 and WO2009013111 disclose a packaging for smoking articles. Both solutions differ from the solution of the invention.

The patent application US2009127148 describes a package of cigarette paper sheets, which differs from the present invention.

The patent application US2002063069 discloses a packaging for smoker's articles, but is void of any additional functions, for instance a device for rolling cigarettes.

The disclosure US2007215165 describes a smoking accessory relating to water pipes and has a function of a water pipe support.

Yet another solution to the packaging for smoker's articles is known from the patent disclosure CN101341076.

SUMMARY OF THE INVENTION

The essence of the packaging and the device for manual rolling of cigarettes of the invention lies in the base line being foldably divided into two small sides with a narrow band therebetween that is terminated on both sides each time by two triangular parts, which provides for a possibility of creating a handy table/tray or manual support for rolling cigarettes.

BRIEF DESCRIPTION OF THE DRAWINGS

The packaging and the device for manual rolling of cigarettes will be described in more detail in the continuation by way of drawings, representing in.

DETAILED DESCRIPTION OF THE DRAWINGS

Figure 1:
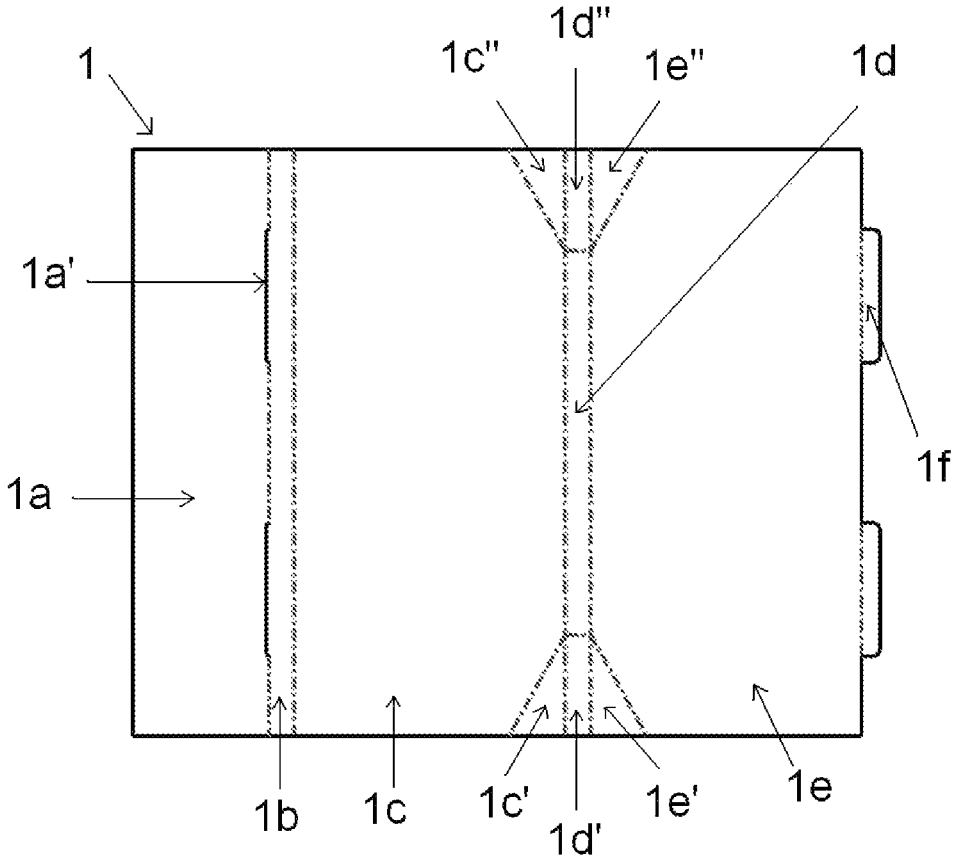
FIG. 1—Top view of the packaging of the invention
Figure 2:
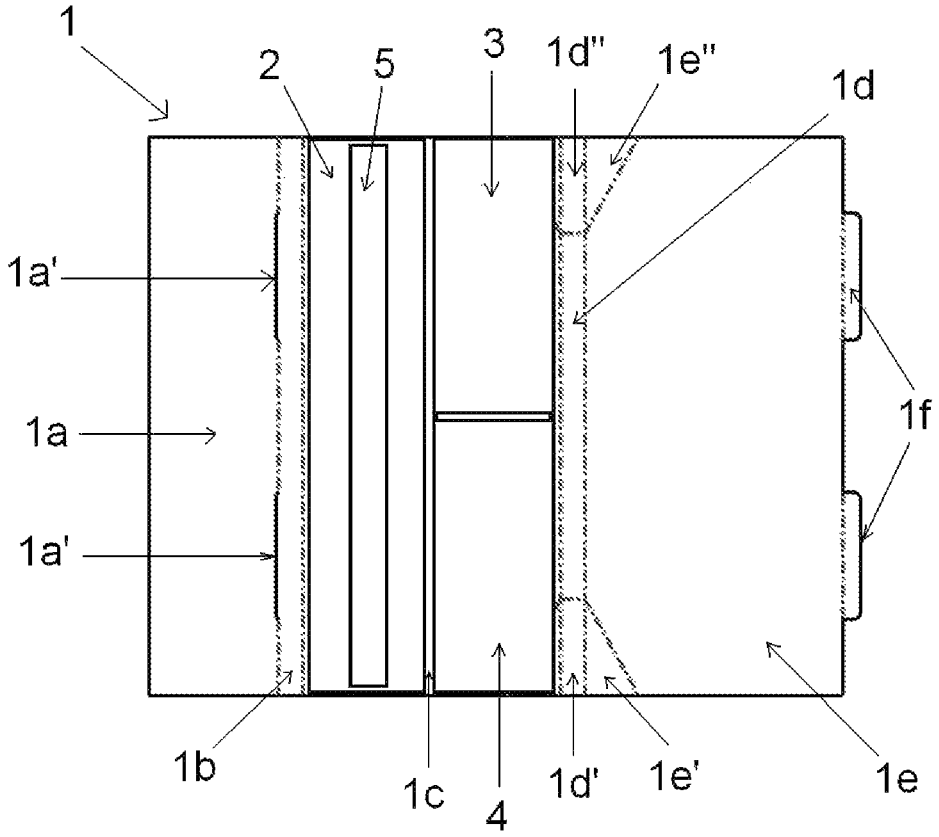
FIG. 2—Packaging of the invention

The packaging and the device for manual rolling of cigarettes of the invention is designed in a way that the base line is foldably divided into two small sides with a narrow band therebetween. The band is terminated at both sides each time with two triangular parts, which provides for creating a handy table for rolling cigarettes. The narrow band is foldably divided in a way that the external parts are embraced by triangular folded corners of smaller sides.

When the device is in use, the packaging is opened and put onto a support in a way that small sides are lift upwards. Triangular sides on both sides of the narrow band are then pushed upwards to create bulges. The two bulges each from its side stop the narrow side and prevent the content from falling from the support. This solution is suitable for both manual as well as table support.

The solution may also have one or two further external sides functioning as legs, when the device is in use. The support thus turns into a stand-alone table.

The packaging and the device for manual rolling of cigarettes of the invention has a base line 1 divided with folding lines into a side 1*a*, a narrow band 1*b*, a first wide side 1*c*, a narrow band 1*d*, a second wide side 1*e* and two lugs 1*f*. The narrow band 1*d* is foldably divided into a part 1*d*' enclosed by a triangular part 1c' and a triangular part 1e'. A part 1d" is enclosed by a triangular part 1c" and a triangular part 1e". Two oblong openings 1a' having the same length as the lugs 1f are provided on the contact line of the side 1a and the narrow band 1b. The lugs may also be in the form of a low trapeze, semi-circle, oval, triangle or any other optional shape having an external side shorter than the side on the contact point with the side 1e. The lugs may also be replaced by clamps of various embodiments.

Figure 4:
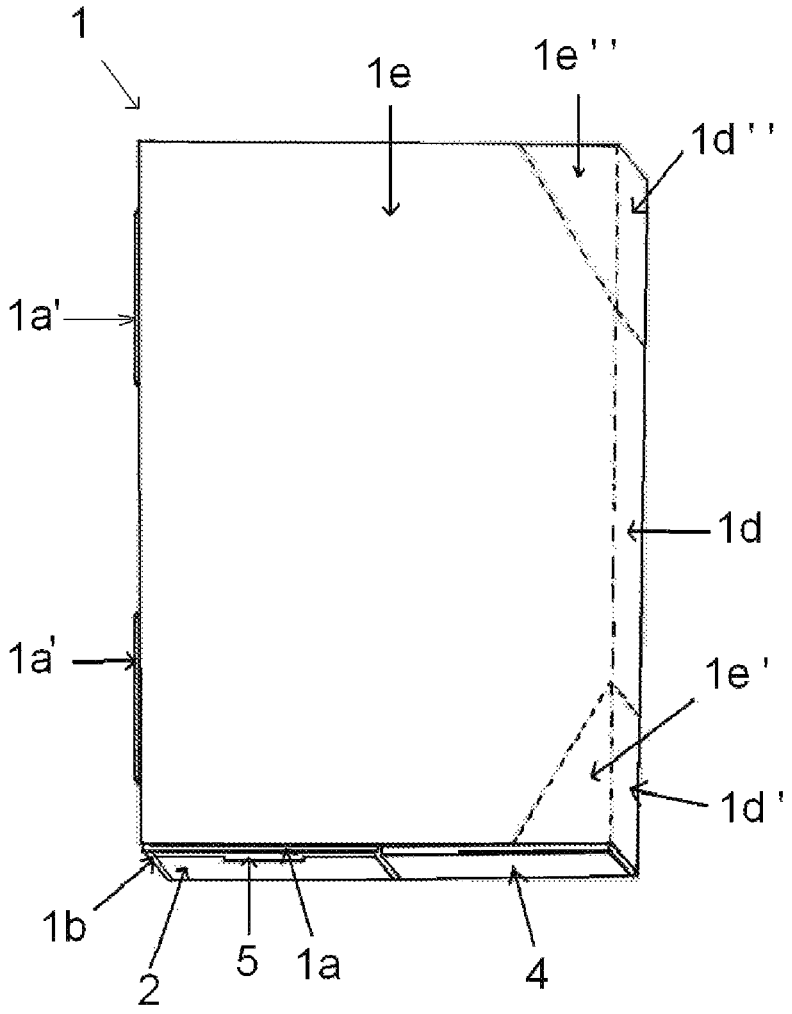
FIG. 4—Side view of the closed packaging
Figure 5:
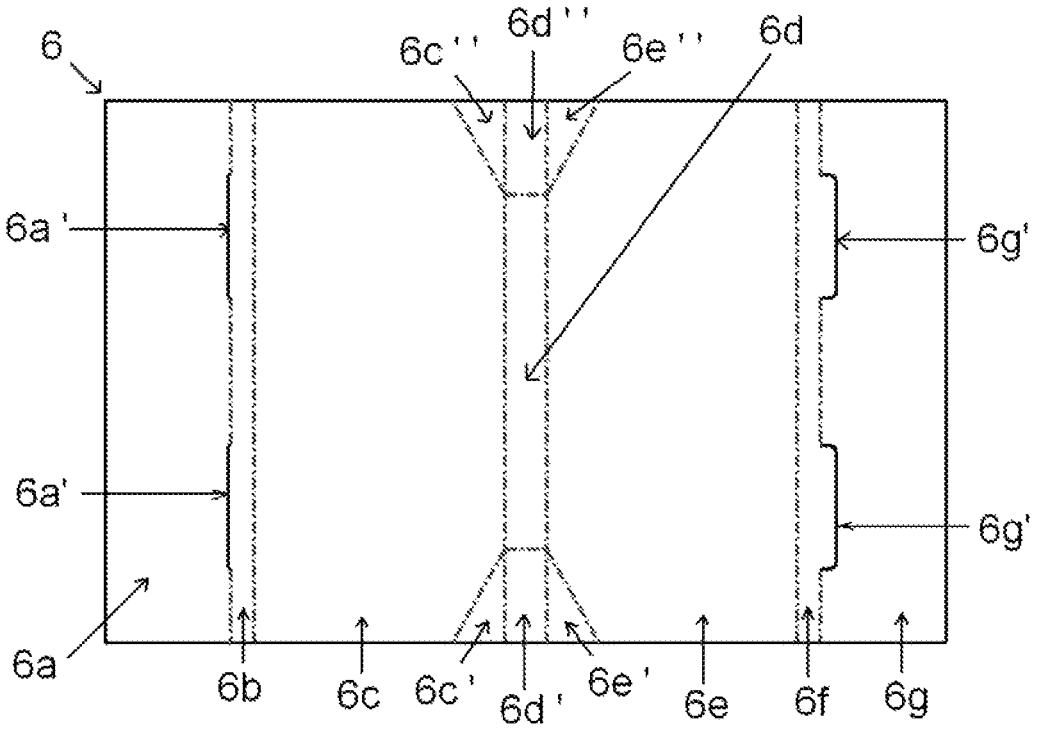
FIG. 5—Top view of the packaging according to Embodiment I
Figure 6:
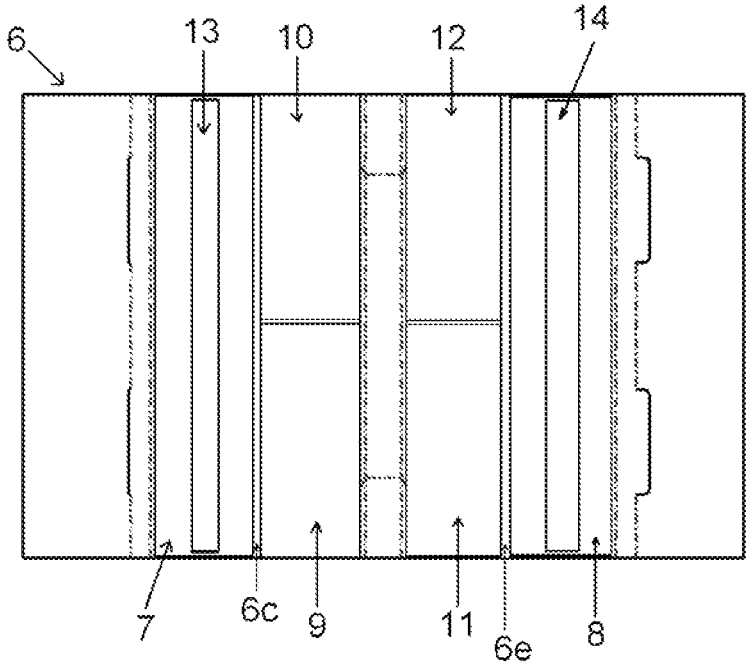
FIG. 6—Top view of the packaging according to Embodiment I—internal part

A container 2 for smoker's accessories 5 as well as smoker's accessories 3 and 4 are glued to the wide side 1c. Smoker's accessories 3 and 4 are glued to the side 1c in a way that no glue is present in the area of the triangular part 1c' and 1c". As the container 2 with the smoker's accessory 5 and the smoker's accessories 3 and 4 are glued to the side 1c, the accessories overlap with the side 1a from one side and with the side 1e from the other side and a thin rectangular packaging as shown in FIG. 4 is formed by means of lugs 1f and oblong openings 1a'. Instead of container 2 for smoker's accessories 5 and smoker's accessories 3 and 4 any other smoker's accessories or any other article serving also as an advertising material may be glued to the side 1c.

Figure 3:
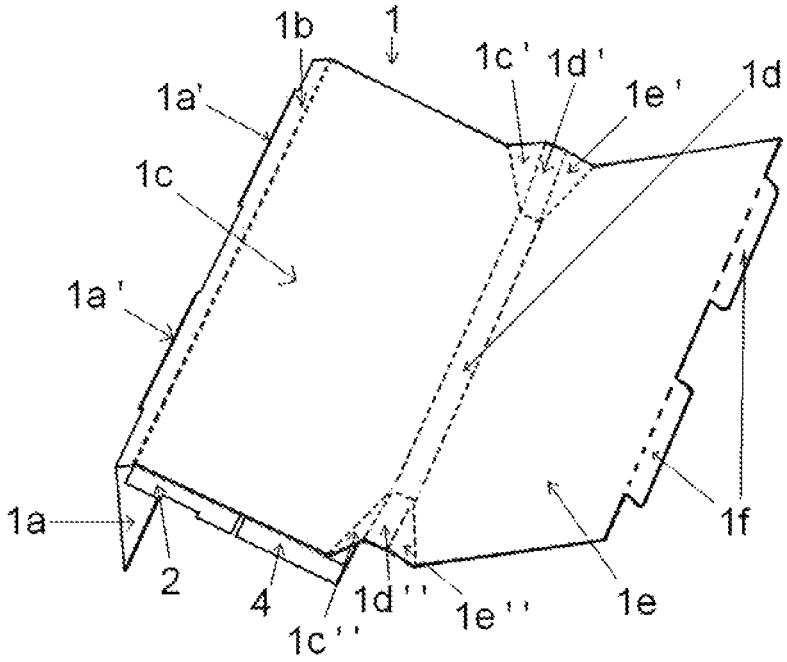
FIG. 3—Side view of the packaging while in use

When a smoker desires to make his own cigarette, he opens the packaging and takes the smoker's accessories packed within the packaging. Then he turns the entire side 1 to the other side and folds the adjacent sides 1c and 1e upwards in the area of the narrow band 1d. The part 1d', the triangular part 1c' and the triangular part 1e' are then also pushed upwards to bulge out. The same procedure is performed on the other side of the side 1d, so that the part 1d" together with the triangular part 1c" and the triangular part 1e" bulge out as well. The base line 1 is put on a table or any other support in a way that the side 1d lies flat and the side 1a leans into the support. The sides 1c and 1e form a cavity defined on the side 1d from both sides by bulges 1c', 1d', 1e' and 1c", 1d", 1e". The bulges function as a spring and hold the side 1e upright in a way to form together with the side 1c leaned against the side 1a a cavity as shown in FIG. 3. Tobacco is then scattered into the cavity and prepared for rolling (crushed, cleaned . . . ). When the tobacco is prepared, one of the bulges in the part 1c', 1d', 1e' or in the part 1c", 1d", 1e" is pushed back to its original position, the support is lifted and the tobacco is transferred to a rolling paper like along a groove. The rolling paper is then repositioned together with the tobacco into the cavity in a way that the paper lies on the side 1d, wherein it is comprised at one side by a bulge in the part 1c', 1d', 1e' or the part 1c", 1d", 1e", which prevents the tobacco from falling out of the paper. On the other side, the paper projects over the support by the length of the side 1d' or 1d", where a filter is arranged at a later stage. Tobacco is then equally distributed over the paper to get a properly shaped cigarette after being rolled, wherein thereafter a filter or a filter sheet rolled into a tube is added. The paper with the tobacco and the filter is then taken into a hand and rolling operation is performed above the cavity/support, so that the tobacco that falls down falls back into the cavity/support and can be re-used or stored in the original packaging. After the rolling operation is over, the packaging is simply turned and closed as shown in FIG. 4.

A packaging and a device for manual rolling of cigarettes according to Embodiment I has a base line 6 with folding lines divided into a side 6a, a narrow band 6b, a first wide side 6c, a narrow band 6d, a second wide side 6e, a narrow band 6f and a side 6g. The narrow band 6d is foldably divided into a part 6d' enclosed by a triangular part 6c' and a triangular part 6e' and at another end by a part 6d" enclosed by a triangular part 6c" and a triangular part 6e". Two oblong openings 6a' having the same length as the lugs 6g' are provided on the contact line of the side 6a and the narrow band 6b. The lugs 6g' may also be in the form of a low trapeze, semi-circle, oval, triangle or any other optional shape having an external side shorter than the side on the contact point with the side 6f.

A container 7 for smoker's accessories 13 as well as smoker's accessories 9 and 10 is glued to the first wide side 6c. Said smoker's accessories 9 and 10 are glued to the side 6c in a way that no glue is present in the area of the triangular part 6c' and 6c". A container 8 for smoker's accessories 14 and smoker's accessories 11 and 12 are glued to the second wide side 6e. The smoker's accessories 11 and 12 are glued to the side 6e in a way that no glue is present in the part of the triangular parts 6e' and 6e".

Figure 8:
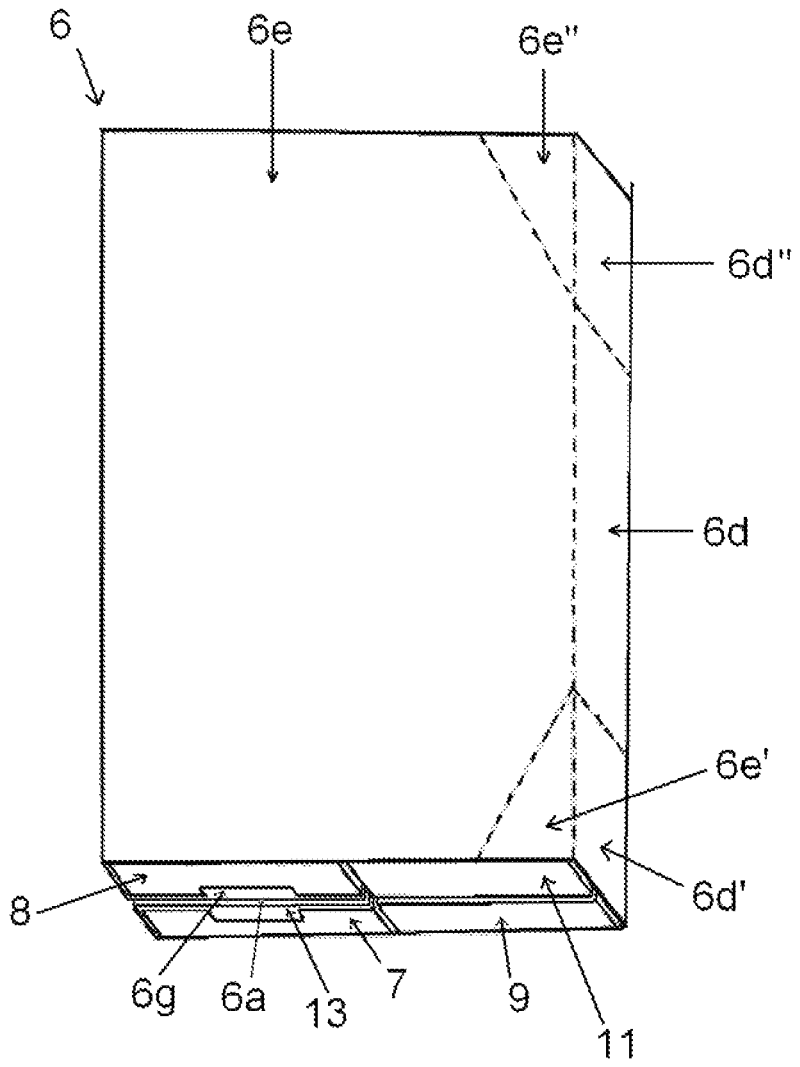
FIG. 8—Side view of the closed packaging according to Embodiment I
Figure 9:
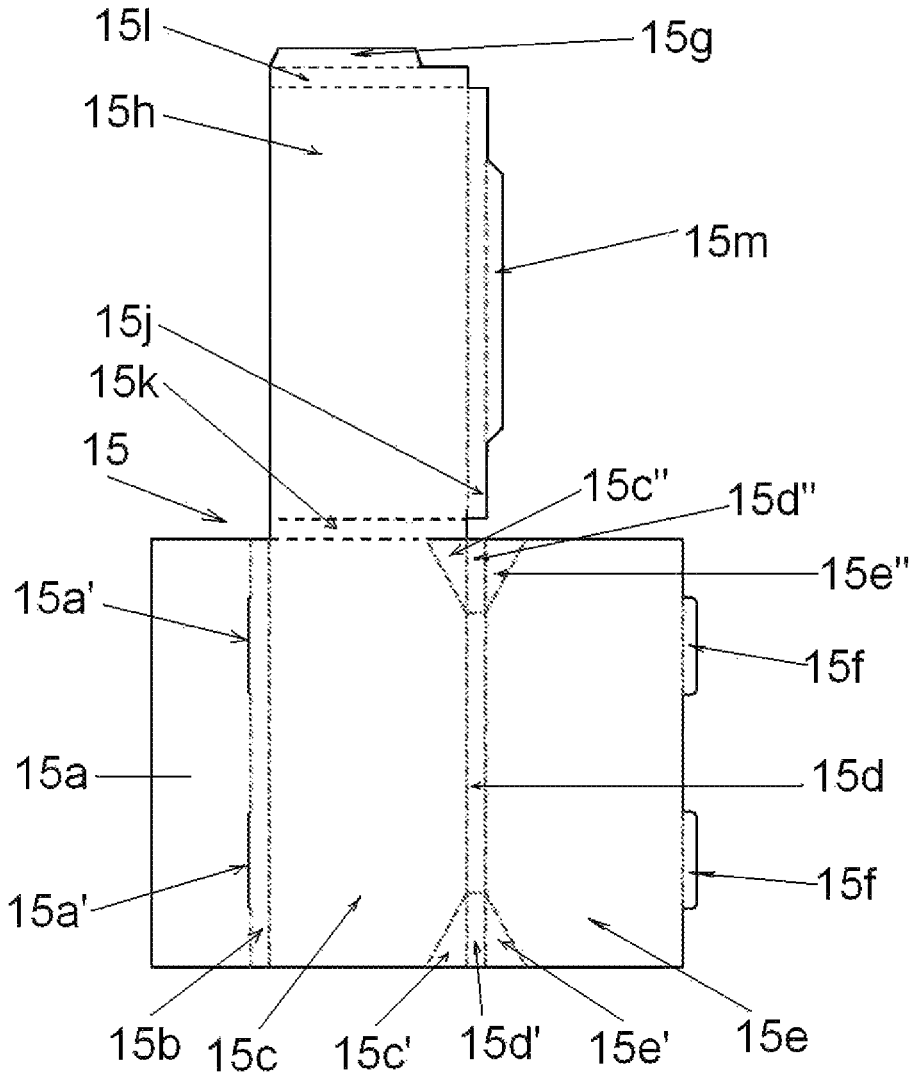
FIG. 9—Top view of the packaging according to Embodiment II
Figure 10:
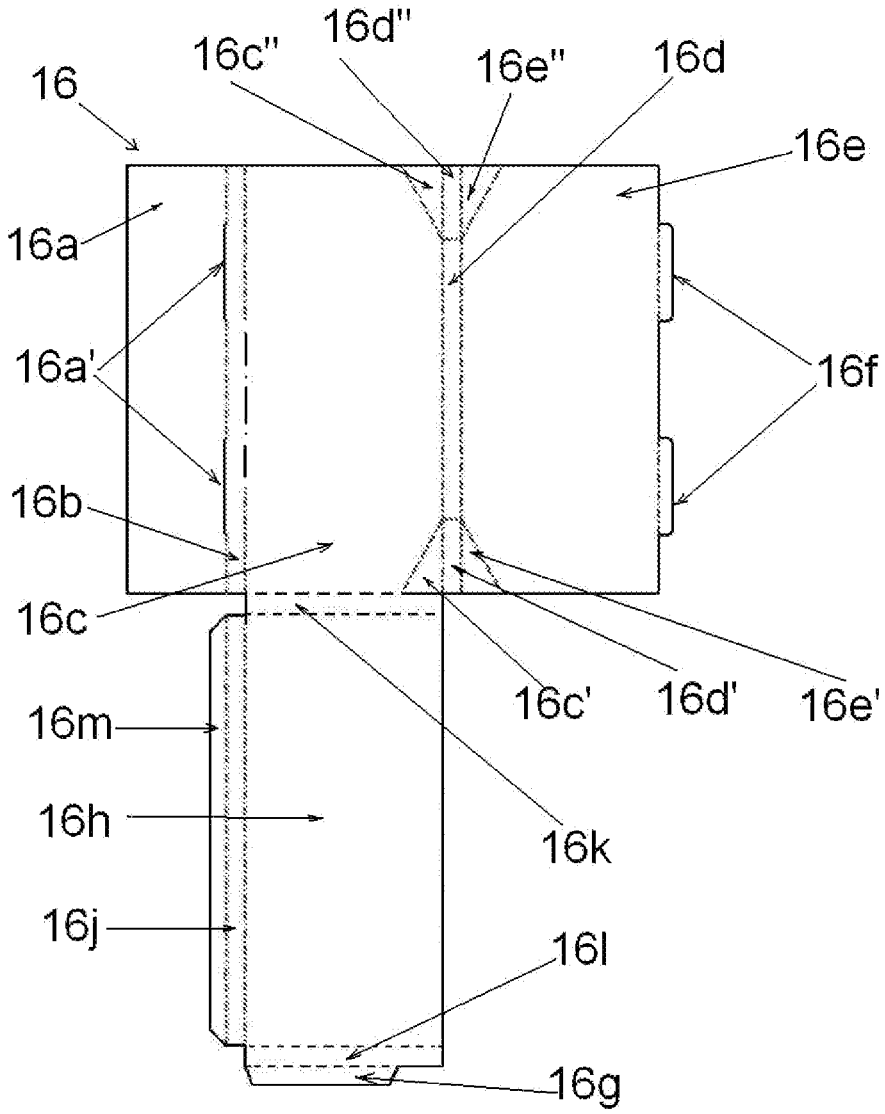
FIG. 10—Top view of the packaging according to Embodiment III
Figure 11:
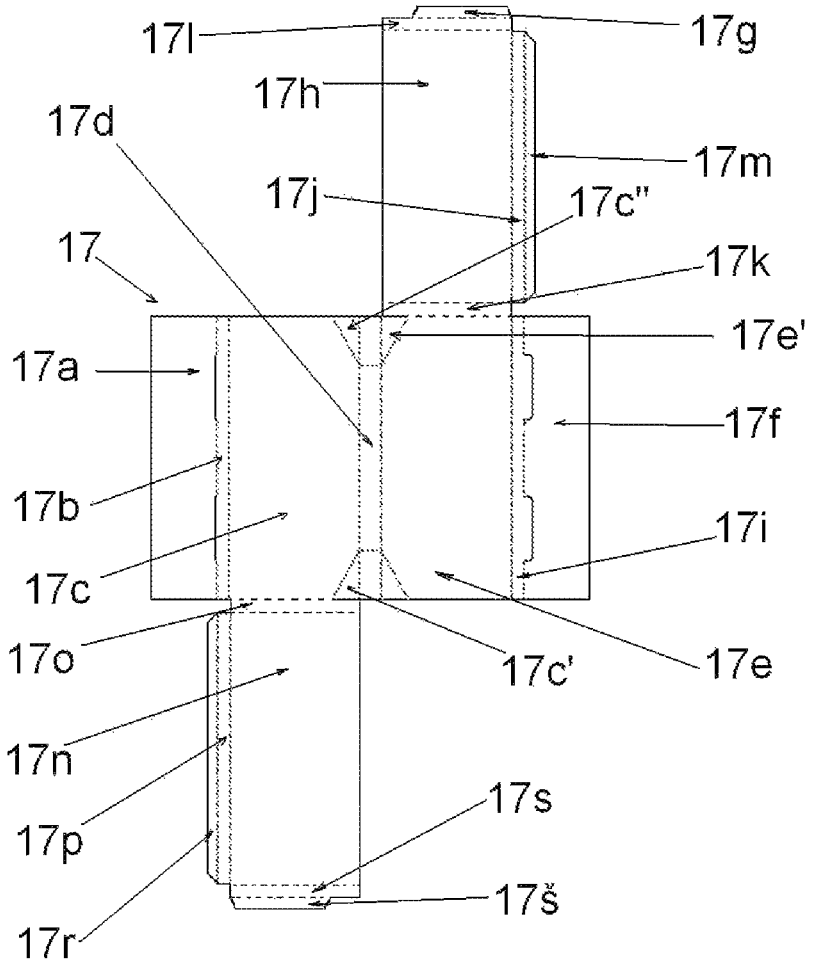
FIG. 11—Top view of the packaging according to Embodiment IV

As the container 7 with the smoker's accessory 13 and the smoker's accessories 9 and 10 are glued to the side 6c, the accessories overlap with the side 6a. As the container 8 with the smoker's accessory 14 and the smoker's accessories 11 and 12 are glued to the side 6e, they overlap with the side 6g. The sides 6c and 6e are then lifted rectangularly with respect to the sides 6d, 6d' and 6d" and closed to a thin rectangular packaging as shown in FIG. 8. When the side 6 is produced lugs 6g' are cut into the side 6g in order to become part of the side 6f. As the side 6e is covered by the side 6g, the lugs 6g' project and are positioned rectangularly with respect to the side 6g. As the sides 6c and 6e are lifted with respect to the sides 6d, 6d' in 6d" and the packaging is closed, the lugs 6g' engage with the openings 6a'. The lugs 6g' may also be in the form of a low trapeze, semi-circle, oval, triangle or any other optional shape with an external side being shorter than the side on the contact point with the side 6f. The lugs may also be replaced by clamps of various embodiments.

Figure 7:
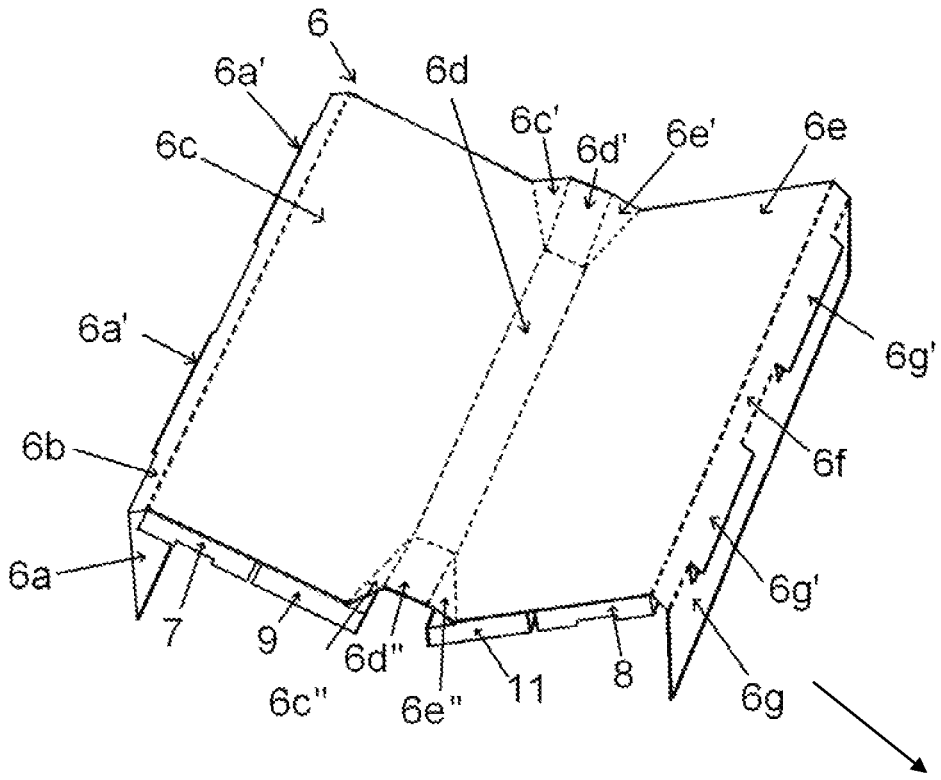
FIG. 7—Side view of the packaging according to Embodiment I

When a smoker desires to make his own cigarette, he opens the packaging and takes the smoker's accessories packed within the packaging. Then he pushes the part 6d', the triangular part 6c' and the triangular part 6e' upwards to bulge out. The same procedure is performed on the other side of the side 6d, so that the part 6d" together with the triangular part 6c" and the triangular part 6e" bulge out as well. The main side 6 is put on a table or any other support in a way that the side 6d lies flat and the side 6a and 6g lean into the support as shown in FIG. 7. The sides 6c and 6e form a cavity defined on the side 6d from both sides by bulges 6c', 6d', 6e' and 6c", 6d", 6e". Tobacco is then scattered into the cavity and prepared for rolling (crushed, cleaned . . . ). When the tobacco is prepared, one of the bulges defined by the parts 6c', 6d', 6e' or 6c", 6d", 6e" is pushed back to its original position, the support is lifted and the tobacco is transferred to a rolling paper like along a groove. The rolling paper is then repositioned together with the tobacco into the cavity in a way that the paper lies on the side 6d, wherein it is comprised at one side by a bulge created by the parts 6c', 6d', 6e' or 6c", 6d", 6e", which prevents the tobacco from falling out of the paper. On the other side, the paper projects over the support by the length of the side 6d' or 6d", where a filter is arranged at a later stage. Tobacco is then equally distributed over the paper to get a properly shaped cigarette after being rolled, wherein thereafter a filter or a filter sheet rolled into a tube is added. The paper with the tobacco and the filter is then taken into a hand and rolling operation is performed above the cavity/support, so that the tobacco that falls down falls back into the cavity/support and can be re-used or stored in the original packaging. After the rolling operation is over, the packaging is simply turned and closed.

One or several containers comprising any smoker's accessories or any smoker's articles may be glued to the sides 6c and 6e. Any other article that can serve also as an advertising material may be glued to the sides 6c and 6e.

A packaging and a device for manual rolling of cigarettes according to Embodiment II has a base line 15 with folding lines divided into a side 15*a*, a narrow band 15*b*, a first wide side 15*c*, a narrow band 15*d*, a second wide side 15*e*, two lugs 15*f*, a third wide side 15*h*, a narrow band 15*k*, a narrow band 15*j* with a trapeze-like shaped band 15*m*, a narrow band 15*l* and a trapeze-like shaped band 15*g*. The narrow band 15*d* is foldably divided into a part 15*d*' enclosed by a triangular part 15*c*' and a triangular part 15*e*'. The part 15*d*" is enclosed by a triangular part 15*c*" and a triangular part 15*e*". Two oblong openings 15*a*' having the same length as the lugs 15*f* are provided on the contact line of the side 15*a* and the narrow band 15*b*. The lugs may also be in the form of a low trapeze, semi-circle, oval, triangle or any other optional shape having an external side shorter than the side on the contact point with the side 15*e*. At the upper edge of the side 15*c* there is a narrow band 15*k* and a third wide side 15*h* having along its longer internal side a narrow band 15*j* with a smaller trapeze-like shaped band 15*m*.

When assembling a packaging according to Embodiment II, folding lines are first made on the internal sides. A third wider side 15*h* is put in parallel with the side 15*c*, onto which a trapeze-like shaped parts 15*g* and 15*m* are glued in a way that no glue is present in the part 15*c*' and the part 15*c*". A narrow rectangular box is formed, into which any smoker's article can be stored. The side 15*c* is then covered by the side 15*a* and the box is thus closed, since the side 15*b* covers the opening. The box is then covered by the side 15*e*, which engages with the lugs 15*f* with the oblong openings 15*a*'. The sides 15*a* and 15*c* may also be joined by a clamp. A portion of the narrow band 15*k* lying at the triangular part 15*c*" must be separated from the latter by a cut in order for the packaging to preserve its functionality.

A packaging and a device for manual rolling of cigarettes according to Embodiment III has a base line 16 with folding lines divided into a side 16*a*, a narrow band 16*b*, a first wide side 16*c*, a narrow band 16*d*, a second wide side 16*e*, lugs 16*f*, a third wide side 16*h*, a narrow band 16*k*, a narrow band 16*j* with a trapeze-like shaped band 16*m*, a narrow band 16*l* and a trapeze-like shaped band 16*g*. The narrow band 16*d* is foldably divided into a part 16*d*' enclosed by a triangular part 16*c*' and a triangular part 16*e*'. The part 16*d*" is enclosed by a triangular part 16*c*" and a triangular part 16*e*". Two oblong openings 16*a*' having the same length as the lugs 16*f* are provided on the contact line of the side 16*a* and the narrow band 16*b*. The lugs may also be in the form of a low trapeze, semi-circle, oval, triangle or any other optional shape having an external side shorter than the side on the contact point with the side 16*e*. At the lower edge of the side 16 there is a narrow band 16*k* and a third wide side 16*h* having along its longer internal side a narrow band 16*j* with a smaller trapeze-like shaped band 16*m*.

When assembling a packaging according to Embodiment III, folding lines are first made on the internal sides. A third wider side 16*h* is put in parallel with the side 16*c*, onto which trapeze-like shaped parts 16*g* and 16*m* are glued. A narrow rectangular box is formed, into which any smoker's article can be stored. The box is covered by the side 16*a* and then covered by the side 16*e*, which engages with the lugs 16*f* with the oblong openings 16*a*'. A portion of the narrow band 16*k* lying at the triangular part 16*c*' must be separated from the latter by a cut in order for the packaging to preserve its functionality.

The packaging according to Embodiment III can also be formed in a way that the base line 16 does not have the side 16*a* and the side 16*b*.

The packaging arrording to Embodiment IV has lateral wings having a base line 17 with folding lines divided into a side 17*a*, a narrow band 17*b*, a first wide side 17*c*, a narrow band 17*d*, a second wide side 17*e*, a narrow band 17*i*, a side 17*f*, a third wide side 17*h*, a narrow band 17*k*, a narrow band 17*j* with a trapeze-like shaped band 17*m*, a narrow band 17*l* with a trapeze-like shaped band 17*g*, a fourth wide side 17*n*, a narrow band 17*o*, a narrow band 17*p* with a trapeze-like shaped band 17*r*, a narrow band 17*s* and a trapeze-like shaped band 17*š*. The side 17*h* is glued by means of bands 17*m* and 17*g* to the side 17*e*, wherewich a pocket for receiving smoker's articles is formed. The side 17*n* is glued to the side 17*c* by means of bands 17*r* and 17*š*, wherewich a pocket for receiving a smoker's article is formed. A part of the side 17*k* lying at the triangular part 17*e*" must be separated from the latter by a cut in order for the packaging to preserve its functionality. A part of the side 17*o* lying at the triangular part 17*c*' must be separated from the latter by a cut in order for the packaging to preserve its functionality.

The packaging according to Embodiment IV can also be formed in a way that the base line 17 has no side 17*a*, no side 17*b*, no side 17*i* and no side 17*f*.

The packaging according to Embodiment IV has a side 17*l* and an adjacent side 17*g* on the upper side of the side 17*h*. The side 17*g* is glued to the side 17*e* in a way that there is no glue on the parts 17*e*'. The sides 17*s* and 17*š* are positioned on the lower side of the side 17*n*, wherein the side 17*š* is glued to the side 17*c* in a way that no glue is present on the parts 17*c*".

Figure 12:
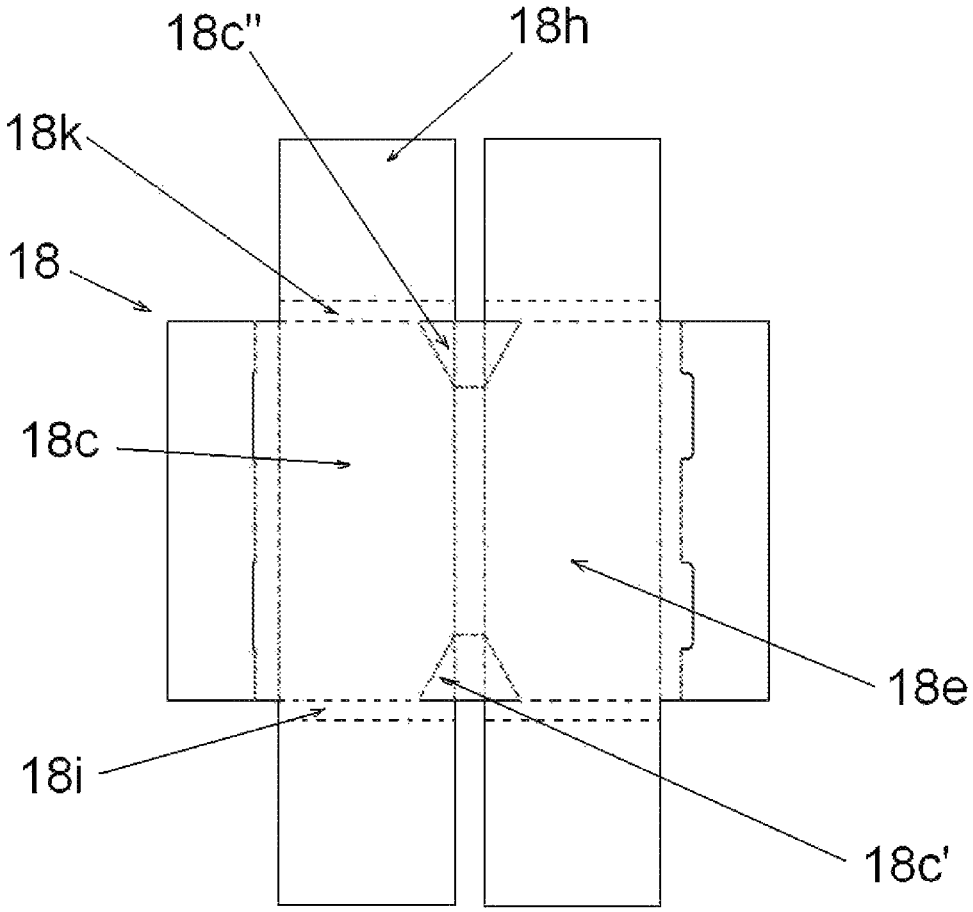
FIG. 12—Top view of the packaging according to Embodiment V

A characteristic feature of the packaging according to Embodiment V as shown in FIG. 12 lies in that a base line 18 is provided with protective lateral wings protecting the contained or glued smoker's accessories while the packaging is used as a table. The wings consist of two parts, of a wide part 18*h* and of a narrow part 18*k*. The wings may have various lengths and dimensions; they can be joined or glued to each other in order to form a pocket for receiving smoker's accessories. A part of the wing in the band 18*k* lying at the triangular part 18*c*" must be separated from the latter by a cut in order for the packaging to preserve its functionality. The wings may be provided at each side lying at the surface, onto which a smoker's accessory or a container therefor is glued. The wings must be separated by a cut in all sides, the surface of which serve for lifting with the purpose of encircling the adjacent surface as described above for the example between the side 18*k* and 18*c*" in order for the surfaces to preserve their functionality. The wings may also be narrower than the width of the surface, onto which the smoker's accessories are glued and can overlap them only partially or overlap only one or several accessories, if more such accessories are glued to the side.

One or several containers for any smoker's accessories or one or more single smoker's accessories may be glued to the location 18*c* and 18*e* or inserted into the mentioned pocket. The location 18*c* and 18*e* may receive any other glued article serving as an advertising material.

In all described solutions to the packaging the triangular surfaces bearing the letters c', c", d', d", e' and e" must not be glued to other surfaces in order to allow formation of a cavity for rolling cigarettes. Smoker's accessories, which can be inserted into pockets or glued to the sides of the packaging may be: cigarette sheets, filter sheets, tobacco, matches, lighters or other smoking articles as well as any other article, which can also serve as an advertising material.

The sides c, e, h and n in all the above-described embodiments may be formed in various combinations of surfaces for gluing and pockets for receiving smoker's and advertising articles.

All packagings may have clamps of various embodiments instead of lugs.

The packaging of the invention solves a problem of construction of a handy packaging provided with a cavity for the preparation of tobacco and manual rolling of a cigarette and storing various smoker's articles into the packaging and good closure thereof. The packaging of the various embodiments can serve to prepare a product comprising various smokers' articles for demanding smokers of different levels.

The invention claimed is:

1. A packaging and a device for manual rolling of cigarettes containing smoker's articles like cigarette sheets, cigarette filters, filter sheets, matches, lighters, tobacco and the like as well as an article that may as well be used as an advertising material comprising that a base (1) divided with folding lines into a side (1*a*), a first narrow band (1*b*), a first wide side (1*c*), a second narrow band (1*d*), a second wide side (1*e*) and two lugs (1*f*); that the second narrow band (1*d*) is foldably divided into a part (1*d*') enclosed by a triangular part (1*c*') and a triangular part (1*e*'); that a part (1*d*") is enclosed by a triangular part (1*c*") and a triangular part (1*e*"); that two oblong openings (1*a*') having the same length as the lugs (1*f*) are provided on the contact line of the side (1*a*) and the first narrow band (1*b*); that the lugs (1*f*) are in the form of a low trapezoid; that a container (2) for smoker's accessories (5) as well as smoker's accessories (3 and 4) are glued to the side (lc) in a way that no glue is present in the area of the triangular part (lc' and lc"); that as the container (2) with the smoker's accessory (5) and the smoker's accessories (3 and 4) are glued to the side (1*c*), the accessories overlap with the side (1*a*) from one side and with the side (1*e*) from the other side and a thin rectangular packaging is formed by means of lugs (1*f*) and oblong openings (1*a*'); that one or several containers comprising any smokers' articles or any smoker's accessory may be glued to the side (1*c*).

2. The packaging and the device for manual rolling of cigarettes as claimed in claim 1, further comprising that the lugs (1*f*) may also be in the form of a semi-circle, oval, triangle or any other optional shape having an external side shorter than the openings (1*a*').

3. The packaging and the device for manual rolling of cigarettes as claimed in claim 1, further comprising variously shaped clamps may be arranged instead of the lugs (1*f*) and openings (1*a*').

4. A packaging and a device for manual rolling of cigarettes, comprising that a base (6) is divided with folding lines into a first side (6*a*), a first narrow band (6*b*), a first wide side (6*c*), a second narrow band (6*d*), a second wide side (6*e*), a third narrow band (6*f*) and a second side (6*g*): that the second narrow band (6*d*) is foldably divided into a part (6*d*') enclosed by a triangular part (6*c*') and a triangular part (6*e*') and at another end by a part (6*d*") enclosed by a triangular part (6*c*") and a triangular part (6*e*"); that two oblong openings (6*a*') having the same length as the lugs (6*g*') are provided on the contact line of the first side (6*a*) and the first narrow band (6*b*); that the lugs (6*g*') may be in the form of a low trapezoid; that a container (7) for smoker's accessories (13) as well as smoker's accessories (9 and 10) are glued to the first wide side (6*c*); that said smoker's accessories (9 and 10) are glued to the first wide side (6*c*) in a way that no glue is present in the area of the triangular part (6*c*' and 6*c*"); a container (8) for cigarette sheets (14) and smoker's accessories (11 and 12) are glued to the second wide side (6*e*); that the smoker's accessories (11 and 12) are glued to the second wide side (6*e*) in a way that no glue is present in the part of the triangular parts (6*e*' and 6*e*"); as the container (7) with the smoker's accessory (13) and the smoker's accessories (9 and 10) are glued to the first wide side (6*c*), the accessories overlap with the side (6*a*); as the container (8) with the smoker's accessory (14) and the smoker's accessories (11 and 12) are glued to the second wide side (6*e*), they overlap with the second side (6*g*); that the first and second wide sides (6*c* and 6*e*) are then lifted rectangularly with respect to the second narrow band and parts (6*d*, 6*d*' and 6*d*") and closed to a thin rectangular packaging by means of lugs (6*g*') and oblong openings (6*a*'); that when the base (6) is produced lugs (6*g*') are cut into the second side (6*g*) in order to become part of the third narrow band (6*f*); that as the second wide side (6*e*) is covered by the second side (6*g*), the lugs (6*g*') project and are positioned rectangularly with respect to the second side (6*g*); that as the first and second wide sides (6*c* and 6*e*) are lifted with respect to the second narrow band and parts (6*d*, 6*d*' and 6*d*"), the lugs (6*g*') engage with the openings (6*a*') and close the packaging; that the lugs (6*g*') are in the form of a low trapezoid; that one or several containers comprising any smokers' articles or any smoker's accessory may be glued to the first and second wide sides (6*c* and 6*e*); that any other article, which may also serve as an advertising material can be glued to the first and second wide sides (6*c* in 6*e*).

5. The packaging and the device for manual rolling of cigarettes as claimed in claim 4, further comprising that the lugs (6*g*') may also be in the form of a semi-circle, oval, triangle or any other optional shape having an external side shorter than the openings (6*a*').

6. The packaging and the device for manual rolling of cigarettes as claimed in claim 4, further comprising variously shaped clamps may be arranged instead of the lugs (6*g*') and the openings (6*a*').

7. A packaging and a device for manual rolling of cigarettes comprising a base (15) with folding lines divided into a first side (15*a*), a first narrow band (15*b*), a first wide side (15*c*), a second narrow band (15*d*), a second wide side (15*e*), lugs (15*f*), a third wide side (15*h*), a third narrow band (15*k*), a fourth narrow band (15*j*) with a first trapezoid like shaped band (15*m*), a fifth narrow band (151) and a second trapezoid like shaped band (15*g*); that the second narrow band (15*d*) is foldably divided into a first part (15*d*') enclosed by a triangular part (15*c*') and a triangular part (15*e*'); that the second part (15*d*") is enclosed by a triangular part (15*c*") and a triangular part (15*e*"); that two oblong openings (15*a*') having the same length as the lugs (15*f*) are provided on the contact line of the first side (15*a*) and the first narrow band (15*b*); that the lugs (15*f*) have a form of a low trapezoid; that at the upper edge of the first wide side (15*c*) there is a third narrow band (15*k*) and a third wide side (15*h*) having along its longer internal side a fourth narrow band (15*j*) with a smaller trapezoid like shaped band (15*m*); that when assembling the packaging, folding lines are first made on the internal sides; that a third wider side (15*h*) is put in parallel with the first wide side (15*c*), onto which the first and second trapezoid like shaped bands (15*g* and 15*m*) are glued in a way that no glue is present in the triangular part (15*c*') and the triangular part (15*c*"); that into the obtained narrow rectangular box any smoker's article can be stored; that the third wide side (15*h*) is then covered by the first side (15*a*) and the box is thus closed, since the first narrow band (15*b*) covers the opening and the box is then covered by the second wide side (15*e*) and fastened by means of lugs (15*f*) into the oblong openings (15*a*'), so that the first side and the third wide sides (15*a* and 15*h*) may also be joined by a clamp; that a portion of the third narrow band (15*k*) lying at the triangular part (15*c*") must be separated from the latter by a cut in order to be able to create a table for rolling cigarettes.

8. A packaging and a device for manual rolling of cigarettes comprising a base line (16) with folding lines divided into a first side (16*a*), a first narrow band (16*b*), a first wide side (16*c*), a second narrow band (16*d*), a second wide side (16*e*), lugs (16*f*), a third wide side (16*h*), a third narrow band (16*k*), a fourth narrow band (16*j*) with a first trapezoid like shaped band (16*m*), a fifth narrow band (161) and a second trapezoid like shaped band (16*g*); that the second narrow band (16*d*) is foldably divided into a first part (16*d*') enclosed by a first triangular part (16*c*') and a second triangular part (16*e*'); that the second part (16*d*") is enclosed by a third triangular part (16*c*") and a fourth triangular part (16*e*"); that two oblong openings (16*a*') having the same length as the lugs (16*f*) are provided on the contact line of the first side (16*a*) and the first narrow band (16*b*); that the lugs (16*f*) are in the form of a low trapezoid; that at the lower edge of the first wide side (16*c*) there is a third narrow band (16*k*) and a third wide side (16*h*) having along its longer internal side a fourth narrow band (16*j*) with a smaller trapezoid like shaped band (16*m*); that when the packaging is assembled, folding lines are first made on the internal sides; that a third wider side (16*h*) is put in parallel with the first wide side (16*c*), onto which the first and second trapezoid like shaped parts (16*g* and 16*m*) are glued; that a narrow rectangular box is formed, into which any smoker's article can be stored; that the box is covered by the first side (16*a*) and then by the second wide side (16*e*), which is fastened by means of the lugs (16*f*) into the oblong openings (16*a*'); that a portion of the third narrow band (16*k*) lying at the first triangular part (16*c*') must be separated from the latter by a cut in order to be able to create a table for rolling cigarettes.

9. The packaging and the device for manual rolling of cigarettes as claimed in claim 8, further comprising that it can also be formed in a way that the base line (16) does not have the side (16*a*) and the side (16*b*).

10. A packaging and a device for manual rolling of cigarettes comprising lateral wings having a base line (17) with folding lines divided into a first side (17*a*), a first narrow band (17*b*), a first wide side (17*c*), a second narrow band (17*d*), a second wide side (17*e*), a third narrow band (17*i*), a second side (17*f*), a third wide side (17*h*), a fourth narrow band (17*k*), a fifth narrow band (17*j*) with a first trapezoid like shaped band (17*m*), a sixth narrow band (17*l*) with a second trapezoid like shaped band (17*g*), a fourth wide side (17*n*), a seventh narrow band (17*o*), an eighth narrow band (17*p*) with a third trapezoid like shaped band (17*r*), a ninth narrow band (17*s*) and a fourth trapezoid like shaped band (17*s*'); that the third side (17*h*) is glued by means of bands (17*m* and 17*g*) to the second wide side (17*e*), wherewith a pocket for receiving smoker's articles is formed; that the fourth wide side (17*n*) is glued to the first wide side (17*c*) by means of third and fourth trapezoid-like shaped bands (17*r* and 17*s*'), wherewith a pocket for receiving a smoker's article is formed; that a part of the fourth narrow band (17*k*) lying at the triangular part (17*e*") must be separated from the latter by a cut in order for the packaging to preserve its functionality; a part of the side (17*o*) lying at the triangular part (17*c*') must be separated from the latter by a cut in order to create a table for rolling cigarettes.

11. The packaging and the device for manual rolling of cigarettes as claimed in claim 10, further comprising that it can also be formed in a way that the base line (17) does not have the side (17*a*), the side (17*b*), the side (17*i*) and the side (17*f*).

12. The packaging and the device for manual rolling of cigarettes as claimed in claim 10, further comprising that the sides (17*l*) and an adjacent side (17*g*) are positioned on the upper side of the side (17*h*); that the sides (17*s* and 17*š*) are positioned on the lower side of the side (17*n*), that the side (17*g*) is glued to the side (17*e*) in a way that no glue is present on the part (17*e*'); that the side (17*š*) is glued to the side (17*c*) in a way that no glue is present on the part (17*c*").

13. A packaging and a device for manual rolling of cigarettes as claimed in claim 4, further comprising comprising that the base (6 or 18) is provided with protective lateral wings protecting the contained or glued smoker's accessories while the packaging is used as a tray; that the wings consist of two parts, of a wide part (18*h*) and of a narrow part (18*k*); that the wings may have various lengths and dimensions and can be joined or glued to each other in order to form a pocket for receiving smoker's accessories; that a part of the wing in the band (18*k*) lying at the triangular part (18*c*") must be separated from the latter by a cut in order to create a table for rolling cigarettes; that one or several containers for any smoker's accessories or one or more single smoker's accessories may be glued to the side (18*c* and 18*e*); that any other article serving as an advertising material can also be glued to the side (18*c* and 18*e*).

* * * * *